US007151080B2

(12) United States Patent
Dostie et al.

(10) Patent No.: US 7,151,080 B2
(45) Date of Patent: Dec. 19, 2006

(54) COMPOSITION FOR STRIPPING COATINGS FROM SUBSTRATES

(75) Inventors: Rick Anthony Dostie, Commerce Township, MI (US); James Christopher Malloy, Ferndale, MI (US)

(73) Assignee: Kolene Corporation, Detroit, MI (US)

( * ) Notice: Subject to any disclaimer, the term of this patent is extended or adjusted under 35 U.S.C. 154(b) by 0 days.

(21) Appl. No.: 11/057,502

(22) Filed: Feb. 14, 2005

(65) Prior Publication Data

US 2005/0233936 A1 Oct. 20, 2005

Related U.S. Application Data

(63) Continuation-in-part of application No. 10/818,829, filed on Apr. 5, 2004, now Pat. No. 6,855,210.

(51) Int. Cl.

| | |
|---|---|
| ***C11D 1/70*** | (2006.01) |
| ***C11D 3/43*** | (2006.01) |
| ***C11D 7/06*** | (2006.01) |
| ***C11D 7/50*** | (2006.01) |

(52) U.S. Cl. ..... 510/176; 510/174; 510/200; 510/201; 510/207; 510/209; 510/213; 510/238; 510/239; 510/240; 510/252; 510/271; 510/272; 510/421; 510/432

(58) Field of Classification Search ..... 510/174, 510/176, 200, 201, 207, 209, 213, 238, 239, 510/240, 252, 271, 272, 421, 432
See application file for complete search history.

(56) References Cited

U.S. PATENT DOCUMENTS

| | | | | |
|---|---|---|---|---|
| 3,790,489 | A | 2/1974 | Shoemaker et al. | 252/103 |
| 3,954,648 | A * | 5/1976 | Belcak et al. | 510/212 |
| 4,978,469 | A * | 12/1990 | Seaman, Jr. | 134/22.17 |
| 5,894,854 | A | 4/1999 | Miles | 134/38 |
| 6,855,210 | B1 * | 2/2005 | Dostie et al. | 134/26 |
| 2003/0144164 | A1 | 7/2003 | Pilznienski et al. | 510/177 |

* cited by examiner

*Primary Examiner*—Brian P Mruk
(74) *Attorney, Agent, or Firm*—Patrick J. Daugherty; Driggs, Hogg & Fry Co., LPA

(57) ABSTRACT

A composition for stripping and cleaning organic coatings from substrates, comprising a solution of high-boiling alcohols, preferably polyglycols, a surfactant, preferably a nonylphenol ethoxylate, and an alkali metal hydroxide, said composition being essentially free of any amines. The composition aggressively and effectively strips paints and other organic coatings without harming underlying substrates damaged by prior art strippers, over conventional or lower time periods, and at conventional or lower temperatures. One embodiment of the invention comprises from about 40% to about 98.9% by weight of a high-boiling alcohol; from about 1% to about 60% of a non-ionic surfactant; and from about 0.1% to about 10% of an alkali hydroxide or mixture of alkali hydroxide.

16 Claims, No Drawings

COMPOSITION FOR STRIPPING COATINGS FROM SUBSTRATES

CROSS REFERENCE TO RELATED APPLICATION

This application is a continuation-in-part of application Ser. No. 10/818,829, filed Apr. 5, 2004—now U.S. Pat. No. 6,855,210 B1, dated Feb. 15, 2005.

BACKGROUND OF THE INVENTION

The removal of organic coatings or residues from a substrate, and particularly the removal of such organic coatings or residues as greases, oils, mold release coatings, polyester coatings, epoxy coatings, paints and other types of coatings, is extremely important in many industries. In particular, organic coatings or residues need to be removed from substrates either for the re-working of a part which has a flawed coating or for reclaiming parts in which the substrate is intact but which requires residues to be removed and/or new coatings to be applied.

It is known that caustic compounds used at elevated temperatures in a fused, essentially anhydrous condition are very effective in removing many types of organic coatings and residues from many types of metal substrates. One such method is taught by U.S. Pat. No. 3,790,489 to Shoemaker et al. However, certain metals, such as zinc, aluminum and magnesium or metallic coatings comprised of these metals or alloys thereof, as well as other metals, alloys, and even non-metallic substrates, are subject to chemical attack or destruction under such conditions as taught in the '489 patent. Thus, such caustic compositions are typically avoided in prior art teachings when removing coatings from metals, such as aluminum, magnesium and zinc.

One prior art approach which avoids the use of a caustic solution is taught by U.S. Pat. No. 5,894,854 to Miles, wherein nonferrous substrate stripping is achieved by using a mixture of triethanolamine and an alkylphenol ethoxylate surfactant at elevated temperatures of about 350° F. While this method is effective for stripping some types of coatings from nonferrous substrates without causing substantial harm to the substrate, this method is unacceptably slow or even ineffective for some applications. Certain coatings are sufficiently chemically resistant that they cannot be efficiently stripped, even with additional post-treatment steps, such as rinsing and pressure spraying.

Another approach is taught by the U.S. patent application of John F. Pilznienski et al. for METHOD AND COMPOSITION FOR REMOVING ORGANIC COATINGS FROM A SUBSTRATE, Ser. No. 10/058,675, filed Jan. 29, 2002, published on Jul. 31, 2003 under Publication No. US-2003-0144164-A1. A composition taught therein includes an ethanolamine organic carrier, non-ionic alkylphenol ethoxylate surfactants and mixtures thereof and potassium hydroxide. The composition is further characterized by being essentially free of water or having a water content low enough so the hydroxide is not ionized to an extent that it will attack zinc, aluminum or magnesium substrates or coatings of such metals.

However, while the Pilznienski et al method is effective in stripping many types of coatings, some coatings are extremely resistant and are not effectively stripped, such as "clearcoat" painted surfaces commonly found on automotive parts, wherein a base or color layer is topped off with a "clearcoat" or "topcoat" layer and cured. Once cured, the clearcoat painted surface provides very good chemical and environmental resistance to corrosion, damage, fading, and permeation of the painted surface. Unfortunately, this superior chemical and environmental degradation resistance also provides significant resistance to stripping. Specifically, clearcoats are formulated to withstand gasoline spills and other chemical exposures that may occur at typical outside environmental temperatures. Accordingly, low temperature applications of stripping mixtures are not likely to break down the clearcoat paint surface and, thus, elevated temperatures must be used to break down the outer shell. Although clearcoated surfaces can be stripped, this requires longer exposure times, and prior art stripping mixtures, such as those taught by Pilznienski et al, must be made more aggressive, either by raising bath temperatures or increasing the potassium hydroxide (KOH) above the preferred values taught therein, or both. Increasing the KOH content of the Pilznienski et al stripping solution adds moisture—even "solid" KOH has about 10% water—and also potentially increases its hygroscopicity; and it has been found that the presence of water within the solution can result in attack of more sensitive or reactive substrates, for example, damage to galvanized metal substrates. And although, in some applications, the mixture may be manipulated to minimize underlying substrate damage, stripping times must then be correspondingly increased greatly for some resistant coatings, resulting in unacceptably long strip times.

Moreover, foaming problems may also arise in the application of a stripping mixture where high wetting agent (surfactant) levels are required or indicated. Foaming problems arise not during application of the prior art stripping mixture itself to an item to be stripped, but during a subsequent water rinse step in the stripping process. Loosened coatings and coating remnants broken down by the stripping mixture are typically removed through the application of water, along with residual stripping mixture, typically through spray washing or a water-rinse bath immersion. Accordingly, steps must be taken to counteract the foaming, resulting in undesirable process problems and inefficiencies.

U.S. Pat. No. 3,954,648 to Belcak et al provides another approach to stripping coatings from various metallic surfaces. Belcak et al teach a solution with three key ingredients—a high-boiling oxygenated solvent (a significant difference and departure from the Pilznienski et al stripping solution teachings), a high boiling liquid amine, and a smaller amount of an alkali metal hydroxide. Belcak et al also suggest the use of a surface active wetting agent if needed. Belcak et al provide a large amount of test data, including various chemical blends, coating types tested, and the test results. However, experiments with solutions according to these teachings as applied in the removal of clearcoat paint coatings also result in unsatisfactory results. In the first place, foaming issues arise unless recommended surfactant amounts are significantly lowered, which inhibits the stripping capacity of the solution. And, significantly, stripping times were unacceptably long for efficient application, with some times exceeding one hour. If more robust solutions are selected from the Belcak et al teachings to address these problems, then substrate damage appears. Numerous experiments with different amine levels invariably return unsatisfactory results in clearcoat stripping, with either unacceptable times or galvanized substrate damage issues.

What is needed is a composition and method which will effectively remove resistant organic surface coatings, such as clearcoat paint, from substrates in a timely fashion without attacking and causing unacceptable damage to the underlying substrates.

SUMMARY OF THE INVENTION

A composition and method for stripping and cleaning organic coatings from substrates, comprising a solution of high-boiling alcohols, preferably polyglycols, a surfactant, preferably a nonylphenol ethoxylate, and an alkali metal hydroxide, said composition being essentially free of any amines. The composition aggressively and effectively strips paints and other organic coatings without harming underlying substrates damaged by prior art strippers, over conventional or lower time periods, and at conventional or lower temperatures. One embodiment of the invention comprises from about 40% to about 98.9% by weight of a high-boiling alcohol; from about 1% to about 60% of a non-ionic surfactant; and from about 0.1% to about 10% of an alkali hydroxide or mixture of alkali hydroxides.

DETAILED DESCRIPTION OF THE INVENTION

The present invention provides for a system and method of stripping organic coatings from underlying substrates through the use of a stripping solution comprising three key components combined within specified relative proportions; a high-boiling alcohol, a non-ionic surfactant and an alkali metal hydroxide, and wherein the solution is essentially free of any amines.

High-boiling alcohols: A variety of different alcohols can be used in the present invention, specifically those having stability and flashpoints suitable with stripping mixture operating temperatures of between 225° F. and 350° F. More preferably, the stripping mixture according to the present invention is operated at temperatures between 250° F. and about 325° F. for stripping clearcoats and other resistant coatings. Accordingly, for safety reasons, it is desirable to have stripping mixture flashpoints at least somewhat greater than the anticipated operating temperature. Another practical concern is the mixture's vapor pressure. It cannot be too high or excessive evaporation of the mixture will occur which will impact the overall viability of the process. Good stripping results have been obtained with polyethylene glycols containing a range of between 4–100 carbon atoms, such as PEG-8. Triethylene and tetraethylene glycols, being smaller molecules than some of the higher polyglycols, are accordingly preferred for their superior coating penetration abilities and stability and flashpoint characteristics at the preferred operation temperatures. Mono and diethylene glycols provide even better penetration abilities due to their smaller structure, but since they have lower flash points, their operational advantages are provided at the lower end of the available operating temperatures, and generally outside of the preferred temperature range for stripping clearcoats and other resistant coatings.

More particularly, the use of tri- and tetraethylene glycols has produced superior stripping results without damage to underlying substrates. Both have demonstrated satisfactory results on a variety of products tested upon, for example, painted automotive components comprising a number of different substrates ("bare" steel, galvanized metals, aluminum). Stripping may be achieved in satisfactory processing times (defined as less than one hour), with acceptable stripper mixture flash points, and vapor pressures. The tri- and tetraethylene glycols both have basically the same vapor pressure—less than 0.01 mm Hg at standard conditions. The flash point of a stripping solution incorporating triethylene glycol was lower than that of one incorporating tetraethylene glycol, and closer to known stripping operating temperatures. A stripping solution incorporating tetraethylene glycol had a higher flash point and still could strip parts in basically the same time frame, perhaps just slightly slower than the triethylene glycol, but not requiring a significant change in processing time.

When using tetraethylene glycol, the stripping solution according to the present invention is preferred to have a composition range between about 40% to about 99% by weight tetraethylene glycol, with a range of about 75% to about 99% by weight being more preferred.

Surfactants. A variety of surface active or wetting agents can be used with the present invention, with non-ionic surfactant wetting agents preferred, wherein a particular surfactant may be indicated responsive to the particular coating to be removed. Appropriate non-ionic surfactants include alkylphenol, ethyleneoxy ethanol, polyalkoxylate and some phosphate esters. A preferred surfactant is based on nonylphenol ethoxylate, wherein a variety can be selected that have a preferred value of from 1 to 12 moles ethoxylate of nonylphenol.

With respect to the surfactant level, a preferred stripping composition range has between about 1% to about 60% by weight. However, testing on a variety of products reveals that where a non-ionic nonylphenol ethoxylate surfactant (such as Surfonic N-60 by Huntsman Corporation) is used, surfactant levels from about 20% to about 25% by weight and above produce longer stripping times and are significantly less effective, dependent upon the particular piece stripped, piece substrate and coating mix. Thus, one preferred range for surfactant level, and in particular for a nonylphenol ethoxylate surfactant, is from about 1% to about 25% by weight.

One advantage of the present invention is that preferred surfactant levels are lower than those found in prior art strippers, such the as the Pilznienski et al and Miles' strippers and, accordingly, foaming issues and related problems are diminished. The Pilznienski et al and Mile' strippers tend to cause a large amount of foaming during water rinse processes which must be controlled, for example, by the addition of antifoaming agents to the rinse water. As the current invention has less surfactant, it generates less foam during comparable water rinsing steps. Thus, there are fewer foaming issues to be addressed, less need for defoaming agents or other countermeasures, thereby improving the efficiencies of the stripping process.

Other nonylphenol ethoxylate surfactants are also appropriate for use with the present invention. For example, Surfonic N-95 and Surfonic N-40 by Huntsman Corporation, or mixtures of N-60, N-95 and N-40, may also be used. (In this designation, the N specifies the hydrophobe as nonylphenyl, and the number (i.e. 60, 95 or 40) indicates a ten-fold multiple of the molar ratio of ethylene oxide to the hydrophobe.) The Surfonic N-60 is preferred since it has reduced foaming properties when the processed components are rinsed in water after stripping.

Others types of surfactants may require other preferred relative levels in a stripping solution for optimum performance, wherein a specific level may be selected responsive to the specific piece stripped, its substrate and/or its coating.

Alkali metal hydroxide. Different alkali metal hydroxides may be practiced with the present invention depending on the particular conditions and needs, including, for example, sodium hydroxide (NaOH) or potassium hydroxide (KOH).

What is important is that the stripping solution must also be being essentially free of water or having a water content low enough so the hydroxide is not ionized to an extent that it will attack zinc, aluminum or magnesium substrates. Thus, as used herein, the term "essentially free of water" means water content at a level which will not ionize the potassium hydroxide to such an extent it will attack aluminum, magnesium or zinc substrates. While NaOH or mixtures of NaOH and KOH may be used, KOH is generally preferred, as it is more easily dissolved in the stripping mixture.

The potassium hydroxide may be added either in solid form or as an aqueous solution of potassium hydroxide. If added in solid form, the resulting composition does not require heating to drive off any excess water. If added in aqueous liquid form, the composition may have to be heated to above the boiling point of water to drive off any excess water to restore the composition to its desired essentially anhydrous condition. Due to the hygroscopicity of the stripping mixture components including the potassium hydroxide, it may be necessary to drive off excess water which may become absorbed by the solution during extended times at ambient or low temperatures.

The time required in the composition varies depending upon the particular coating or residue being treated, the thickness of the coating or residue, the potassium hydroxide content of the composition, the operating temperature of the composition, and the make-up of the carrier. This may be as little as a few minutes to as much as several hours depending upon the nature of the coating, the thickness thereof and the uniformity of the coating. When the substrate with the treated coating is removed from the bath, a post treatment, such as a water rinse or water spray, may be performed to remove any vestiges of the coating or residue left. In some cases, however, such post treatment is not necessary.

It has been found that, if the composition is maintained essentially free of water, the alkali metal hydroxide will not attack substrates that would normally be attacked by such alkali metal hydroxides when sufficient water is present to ionize the hydroxide, such as zinc, aluminum, magnesium and other such metals and alloys thereof. Thus, while the composition may be used to remove coatings on substrates other than metals which are susceptible to attack by alkali hydroxides when sufficient water is present to ionize the potassium hydroxide, it is particularly useful for removing coatings and residues from such substrates, such as aluminum, magnesium and zinc or alloys thereof, which are susceptible to such attack by potassium hydroxides without such attack occurring when the composition is maintained essentially free of water. A preferred level range of KOH within a stripping solution according to the present invention is from about 0.1% to about 10% by weight, with a more preferred range of from about 0.1% to about 5% by weight.

As more parts are stripped, a bath of the stripper solution will accumulate more paint and/or other coating materials dissolved into it, and the stripping effectiveness of the bath will correspondingly decrease. Experiments on lab and production parts indicate a preferred minimum "active level" of around 0.75% KOH should be maintained in the stripping solution according to the present invention, with an active level of around 1% KOH preferred for a large variety of part sizes and characteristics. Some parts and/or coatings may require up to about a 2% KOH activity level. Some coatings may benefit more from higher activity levels, and the invention may be practiced at about a 3% KOH level, but this does not generally result in a significant improvement in process times. A typical clearcoated product that may be stripped in about 45 minutes at a 2% KOH activity level may strip in about 35–40 minutes at a 3% KOH activity level. The potassium hydroxide also acts to lower the freezing point of the composition.

What is important is that the stripping solution according to the present invention should be essentially amine free. One skilled in the art will recognize that the term "essentially amine free" is conventionally understood to be a composition "fundamentally without" amines: one that may have unavoidable amine impurities, yet at quantities below the point that materially affects the basic characteristics of the invention claimed. Experiments have found that the presence of amines at any component level within the stripping solution will result in unacceptable attack upon galvanized metals and other substrates. Compositions according to the present invention may contain free amine ions or amine group impurities at a relative percentage of below 1%: an amine content low enough so that soft metals such as zinc, aluminum or magnesium substrates or coatings of such metals (such as galvanized metal) will not suffer attack or adverse impact.

While temperatures of between 225° F. and 350° F. can be used, preferably the temperatures are between about 250° F. and 325° F. The amount of potassium hydroxide contained in the composition can be determined by conventional acid/base titration utilizing a standardized acid and a pH meter to the desired end point. According to the present invention, the stripping solution is preferably used in a "bath" or immersion process, wherein a series of parts or batches of parts are submerged into the solution in seriatim, each part or batch submerged for a time sufficient to either completely strip the specific coating or loosen it enough to be rinsed off in a subsequent step. However, this should in no way restrict the instant invention to this mode of practice only. The stripping solution may also be sprayed onto the surface to be stripped. It may be used in combination with an immersion soak, either preceded or followed by spray application, or both.

Substrates and coatings. The present invention is appropriate for use on steel (both with and without a galvanized Zn layer), roll-formed steel, zinc die-cast products, aluminum, aluminum die-cast products, brass, bronze, copper, titanium, magnesium, plated substrates, and non-metallic substrates, such as plastics.

Typical automotive components stripped include exterior sheet metal components, aluminum wheels and plastic headlight housings. Non-automotive components include architectural hardware, lighting components, plumbing fixtures and electronics housings.

The preferred application of the stripping solution and method of the present invention is the stripping of organic-based systems. These include: electro-deposition coatings, powder coatings (acrylics, polyesters, TGIC, epoxies, urethanes, and hybrid formulations), primer coatings (acrylics, epoxies, and urethanes), solvent-based and water-based organic coatings (primarily acrylics, urethanes and epoxies), and one and two component clearcoat technologies (primarily acrylic and urethane formulas). Certain enamels and lacquer coatings can also be removed. An exemplary list of the types of common coatings that may be stripped according to the present invention includes:

Cathodic electrocoats (both lead and non-lead types);

Powder primers (polyester, hybrids and acrylic types);

Powder monocoats;

Liquid monocoats;

Liquid solvent basecoats; and

Liquid one and two component acrylic clearcoats.

Composite coatings with multiple layers may also be successfully stripped. An exemplary list includes:

An epoxy coat ("Ecoat") with an upper powdercoat;

An Ecoat, basecoat, clearcoat composite paint;

An Ecoat, monocoat composite paint; and

An Ecoat, primer, basecoat, clearcoat composite paint.

EXAMPLE 1

A Formula #1-3E according to the present invention comprising 88% triethylene glycol, 10% Surfonic N-60 surfactant and 2% liquid KOH (with 1% active KOH) was tested in direct comparison with a Pilznienski et al solution (comprising 88% triethanolamine, 10% Surfonic N-60 surfactant and 2% liquid KOH (with 1% active KOH)). A galvanized metallic substrate with a silver basecoat covered with a clearcoat was submerged in a bath of Formula #1 heated to about 310° F. The clearcoat and base coat were stripped in about 45 minutes, with no apparent attack or harm to the galvanized metallic substrate, and only mild rinsing required after stripping. It is also important to note that this temperature is significantly lower than the temperature typically required by the Pilznienski et al solution for timely stripping of paints and other resistant coatings (from greater than 310° F. to about 350° F.). In contrast, a bath of the Pilznienski et al solution at similar temperatures had no apparent effect on the clearcoat over the same time 45 minute period and it was, in fact, unable to strip the part in any reasonable amount of time.

Further testing of Formula #1-3E established its ability to also strip other coatings, such as powdercoats, ecoats, and other basecoat/clearcoat combinations. As the evaporation rate of Formula #1-3E was greater than the Pilznienski et al solution, the lower temperature operability is an important advantage. However, lowering the temperature to about 275° F. might extend stripping times to around 1.5 hours, outside of a target maximum of one hour, which is usually met at temperatures of around 300° F. Temperatures nearer to 310° F. are preferred, with a preferred range of from about 300° F. to about 325° F.

Adjusting the level of the alkali metal hydroxide up and down also affected stripping performance. It is important to maintain an activity level of about 1%, wherein lower amounts slow down the stripping process. Higher amounts do not seem to greatly improve strip times, and significantly higher levels might start to initiate a small amount of galvanized substrate attack, but much less than that seen in the Pilznienski et al solution at comparable levels. Thus, the preferred alkali metal hydroxide level is from about 1% to about 2%.

EXAMPLE 2

In order to observe the effects of amines upon clearcoated galvanized substrates, Formula #1-3E was altered to incorporate an amine according to the Pilznienski et al application. Specifically, 18% triethanolamine was incorporated by correspondingly reducing the triethylene glycol to 70%, holding the Surfonic N-60 surfactant at 10% and the liquid KOH at 2% (with 1% active KOH) to achieve a Formula #2-3E. Although Formula #2-3E can strip the clearcoat in under an hour, specifically in about 45 minutes at 325° F., the galvanized substrate is attacked and darkened.

EXAMPLE 3

A higher-surfactant Formula #3-3E of 60% triethylene glycol, 38% Surfonic N-60 surfactant and 2% liquid KOH (1% active KOH) is compared to Formula #1-3E. Formula #3-3E also strips clearcoat and powdercoats well. Although slower than Formula #1-3E in stripping clearcoats, it is as fast or quicker in stripping powdercoat paints.

EXAMPLE 4

Formula #1-3E is tested in comparison to two other stripping solutions. The first (Formula #3-3E-A) is similar to Formula #3-3E but has a small amount of surfonic replaced by an amine—60% triethylene glycol, 37% Surfonic N-60 surfactant, 1% triethanolamine and 2% liquid KOH (1% active KOH). The second (Miles solution) is a formulation according to the Miles patent of triethanolamine with an alkylphenol ethoxylate surfactant.

Formula #1-3E stripped a clearcoated galvanized part in between 35 and 40 minutes at temperatures from about 310° F. to about 325° F. Formula #3-3E-A took slightly longer at 45 minutes, with possible harm to the substrate. Both required only mild rinsing. In contrast, the Miles solution took unacceptably long, over 90 minutes, over the same temperature range, and required much stronger rinsing.

In other experiments with the relative proportions taught by Formula #1-3E, tetraethylene glycol was substituted for the triethylene glycol in the same amount to produce Formula #1-4E. As tetraethylene glycol has a higher flashpoint and higher boiling point, higher temperature applications are enabled, and thus process times may be accordingly reduced for some coatings. Where similar temperatures are used, for example 325° F., the stripping process times of Formula #1-3E and Formula #1-4E both meet target maximum times of one hour for similar paint coatings, and are thus generally operationally equivalent.

Furthermore, in order to test the effects of Formula #1-4E upon underlying substrates, stripping experiments were also conducted over much longer timeframes. A galvanized metal substrate having a thickness of about 0.0007 inches and coated with an Ecoat first layer and powdercoat upper paint layer forming a composite coating layer 0.0033 inches thick was immersed for time periods ranging between 12 and 14 hours in a Formula #1-4E solution at 300° F. At the end of these time periods, the Ecoat and powdercoat layers were stripped from the galvanized substrate, yet the galvanized layer thickness was undiminished.

EXAMPLE 5

In another formulation, Formula #1-4E was altered to replace the 10% Surfonic N-60 with a diethanolamide as taught by the Miles patent; specifically, 10% coconut oil (calamide C) was combined with 88% tetraethylene glycol and 2% liquid KOH (1% active KOH) to create Formula #1-4E-C. A Formula #1-4E comprising 88% tetraethylene glycol, 10% Surfonic N-60 surfactant and 2% liquid KOH (1% active KOH) stripped a basecoat/clearcoat paint in about 45 minutes at 325° F., whereas the Formula #1-4E-C took over 90 minutes, and seemed to undercut the substrate while "bubbling off" the paint. Powdercoat painted substrates took about three hours to strip in the same Formula #1C. Thus, the diethanolamide taught by Miles drastically slows or virtually stops the stripping process. But incorporating a nonylphenol ethoxylate surfactant according to the present invention significantly aids in cutting through both clearcoats and powdercoats.

Formula #1-4E also stripped coated galvanized metal substrates with the following four composite paint coatings: (1) Ecoat, black powdercoat, (2) Ecoat, silver basecoat/clearcoat, (3) Ecoat, black powdercoat (wide part) and (4) Ecoat, red basecoat/clearcoat. Each composite paint coating required about 45 minutes to strip at 300° F.

EXAMPLE 6

Table 1 illustrates the behavior of stripping solutions according to the present invention responsive to the selection of the high-boiling alcohol. In each of the tests, the stripping solution comprised about 10% by weight of Surfonic N-60 surfactant; the remainder was typically about 88% by weight of the high-boiling alcohol indicated and about 2% by weight liquid KOH (with 1% active KOH), although sometimes the KOH/alcohol proportion was altered to increase or decrease the relative KOH level as indicated. Stripping with the alcohol solutions (butyl, hexanol and pentanol) all were done at fairly low temperatures of 100° F. to 125° F., due to flashpoint and evaporation concerns. Stripping with the more stable glycols were all done at around 300° F. The table reflects general rating results based on the ability to strip a particular coating, wherein "fail" means no stripping happened over many hours (for example, eight or more hours). A "marginal" or "fair" result means it took at least two hours for stripping to take place, and perhaps several hours to complete. "Good" or "excellent" ratings show a definite stripping capability, with "excellent" indicating stripping in less than one hour generally.

TABLE 1

| Formula | Coating Type Powdercoat-Exterior | Coating Type Basecoat/Clearcoat-Exterior |
|---|---|---|
| Buty/Alcohol | Fail | Fail |
| Pentanol | Fail | Fail |
| Hexanol | Fail | Fail |
| Polyethylene Glycol | Good | Marginal |
| Triethylene Glycol | Excellent | Excellent |
| Tetraethylene Glycol | Excellent | Excellent |
| Tetraethylene Glycol & 3% KOH | Excellent | Excellent |
| Tetraethylene Glycol & 0.5% KOH | Good | Fair |

All formulae contain 10% surfactant and 1% active KOH unless otherwise noted

The present invention is also appropriate for safely stripping other substrates. For example, Formula #1-4E stripped a plastic nylon substrate with a white basecoat/clearcoat paint coating at 300° F. in about one hour. Other successfully stripped substrates within one hour at 300° F. include multiple types (steel and aluminum) with black powder coats (Ecoat undercoat), various colored (steel and aluminum) basecoat/clearcoat parts (Ecoat undercoat), and zinc die cast parts with Ecoat/powdercoat. A single cured electrocoat film can be removed in as little as five minutes. Where only a single powdercoat layer is present, the stripping can be achieved in about 15 to about 30 minutes. A single basecoat/clearcoat layer typically takes about 30 to about 45 minutes.

The present invention can also be used for cleaning or stripping other organic materials from substrates, such as, for example, dirt, grease and oils. Aluminum wheels can thus be cleaned in a range of from about 15 to about 60 minutes at 300° F., with a subsequent ambient air cooling period and a water rinse. Other appropriate applications include engine components that have organic soils, such as grease, carbon, oils, and aluminum bread pan cleaning of organic residues and stripping organic release coatings. Another advantage is that chromate coatings on zinc or aluminum substrates are virtually unaffected through the stripping processes.

Thus, what is new and unexpected is that, according to the present invention, stripping solutions comprising high-boiling alcohols (and in particular polyglycols), non-ionic surfactants and alkali hydroxides are much more aggressive in acting upon paints, such as clearcoat and powdercoats, than prior art stripping solutions comprising alternative components, such as amine carriers and diethanolamide surfactants. What is also new and unexpected is that these stripping solutions, according to the present invention, provide aggressive stripping of paints and other resistant organic coatings without harming underlying substrates previously harmed by prior art strippers, over conventional or lower times, and at conventional or lower temperatures.

While preferred embodiments of the invention have been described herein, variations in the design may be made, and such variations may be apparent to those skilled in the art of materials stripping, as well as to those skilled in other arts. The scope of the invention, therefore, is only to be limited by the following claims.

What is claimed is:

1. A composition for removing organic coatings from a substrata, comprising:

from about 40% to about 98.9% by weight of a high-boiling alcohol;

from about 1% to about 60% by weight of a non-ionic surfactant; and from about 0.1% to about 10% by weight of an alkali hydroxide or mixture of alkali hydroxides;

said composition being anhydrous and essentially free of any amines.

2. The composition as defined in claim 1 wherein the alkali hydroxide or mixture of hydroxides is selected from the group of KOH, NaOH, and mixtures thereof.

3. The composition as defined in claim 1 wherein the alkali hydroxide or mixture of alkali hydroxide is from about 0.5% to about 5% by weight.

4. The composition as defined in claim 1 wherein the high-boiling alcohol is a glycol having from 4 to 100 carbon atoms.

5. The composition as defined in claim 4 wherein the glycol is selected from the group of a polyglycol, ethylene glycol, triethylene glycol and tetraethylene glycol.

6. The composition as defined in claim 4 wherein the glycol is from about 75% to about 98.5% by weight.

7. The composition as defined in claim 1 wherein the surfactant is an ethoxylate of nonylphenol.

8. The composition as defined in claim 1 wherein there is between about 1% and about 25% by weight of the surfactant.

9. A composition for removing organic coatings from a substrate, consisting of:

from about 40% to about 98.9% by weight of a high-boiling alcohol;

from about 1% to about 60% by weight of a non-ionic surfactant; and from about 0.1% to about 10% by weight of an alkali hydroxide or mixture of alkali hydroxides.

10. The composition as defined in claim 9 wherein the alkali hydroxide or mixture of hydroxides is selected from the group of KOH, NaOH, and mixtures thereof.

11. The composition as defined in claim 9 wherein the alkali hydroxide or mixture of alkali hydroxide is from about 0.5% to about 5% by weight.

12. The composition as defined in claim 9 wherein the high-boiling alcohol is a glycol having from 4 to 100 carbon atoms.

13. The composition as defined in claim 12 wherein the glycol is selected from the group of a polyglycol, ethylene glycol, triethylene glycol and tetraethylene glycol.

14. The composition as defined in claim 12 wherein the glycol is from about 75% to about 98.5% by weight.

15. The composition as defined in claim 9 wherein the surfactant is an ethoxylate of nonylphenol.

16. The composition as defined in claim 9 wherein there is between about 1% and about 25% by weight of the surfactant.

* * * * *

UNITED STATES PATENT AND TRADEMARK OFFICE

CERTIFICATE OF CORRECTION

PATENT NO. : 7,151,080 B2
APPLICATION NO. : 11/057502
DATED : December 19, 2006
INVENTOR(S) : Dostie et al.

It is certified that error appears in the above-identified patent and that said Letters Patent is hereby corrected as shown below:

Claim 1
Column 10, line 28 change “substrata” to --substrate--.

Signed and Sealed this

Third Day of April, 2007

JON W. DUDAS
*Director of the United States Patent and Trademark Office*